US010876305B2

(12) United States Patent
Underkofler et al.

(10) Patent No.: US 10,876,305 B2
(45) Date of Patent: Dec. 29, 2020

(54) BUILDING PERIMETER SYSTEMS

(71) Applicant: USG Interiors, LLC, Chicago, IL (US)

(72) Inventors: Abraham M. Underkofler, Salem, WI (US); Peder J. Gulbrandsen, Aurora, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 16/420,438

(22) Filed: May 23, 2019

(65) Prior Publication Data

US 2020/0370310 A1 Nov. 26, 2020

(51) Int. Cl.
*E04F 19/04* (2006.01)
*E04F 19/06* (2006.01)
*E04B 9/30* (2006.01)

(52) U.S. Cl.
CPC ..... *E04F 19/0468* (2013.01); *E04B 9/30* (2013.01); *E04F 19/061* (2013.01); *E04F 2019/0413* (2013.01)

(58) Field of Classification Search
CPC ..... E04B 9/30; E04F 19/0468; E04F 19/061
See application file for complete search history.

(56) References Cited

U.S. PATENT DOCUMENTS 826,904 A * 7/1906 Spelman ..... E04B 9/30 52/506.06
2,389,171 A * 11/1945 Urbain ..... E04B 9/30 52/283
3,435,876 A * 4/1969 Toti ..... A47H 2/00 160/38
4,156,270 A * 5/1979 Beatty ..... F21V 17/04 362/145
4,254,813 A * 3/1981 Vecchiarelli ..... A47H 2/00 160/19
4,533,981 A * 8/1985 Radek ..... F21V 21/02 362/151
4,858,409 A * 8/1989 Handley ..... E04B 9/30 52/506.09
5,296,964 A * 3/1994 Shopp ..... G03B 21/58 160/19

(Continued)

FOREIGN PATENT DOCUMENTS

DE 8702250.8 U1 3/1988
DE 10 2013 014081 B3 12/2014

(Continued)

OTHER PUBLICATIONS

International Search Report and the Written Opinion of the International Searching Authority, or the Declaration dated Aug. 18, 2020 for PCT/US2020/033384, filed May 18, 2020.

*Primary Examiner* — James M Ference
(74) *Attorney, Agent, or Firm* — Pearne & Gordon LLP

(57) ABSTRACT

An architectural perimeter pocket assembly having at least a top and an inner side for forming an open bottom pocket, the inner side including an upper section and a lower extension section separately formed from the upper section, the sections having mutual engageable coupling formations horizontally displaced from main portions of said sections that when engaged enable the upper section to support the lower extension section vertically and restrain the lower section from pendulum-type motion.

2 Claims, 1 Drawing Sheet

(56) References Cited

U.S. PATENT DOCUMENTS 6,111,694 A * 8/2000 Shopp ..... G03B 21/58 160/23.1
6,230,782 B1 * 5/2001 Reichert ..... E06B 9/17023 160/23.1
6,253,492 B1 * 7/2001 Finke ..... E05D 1/06 49/409
6,388,404 B1 * 5/2002 Schnebly ..... E06B 9/32 318/16
6,421,175 B1 * 7/2002 Shopp ..... G03B 21/58 160/310
6,430,888 B1 * 8/2002 Dombchik ..... E04C 3/06 52/653.1
6,446,394 B1 * 9/2002 Finke ..... E05D 15/0652 49/409
6,816,308 B1 * 11/2004 Shopp ..... G03B 21/58 160/23.1
6,873,461 B1 * 3/2005 McPherson, Jr. ..... E06B 9/50 160/23.1
8,505,865 B2 8/2013 Wills et al.
8,800,212 B2 * 8/2014 Thrush ..... E04B 2/00 52/36.5
9,115,537 B2 * 8/2015 Blair ..... E06B 9/42
9,464,433 B1 * 10/2016 Hulka ..... E04B 9/10
9,476,194 B1 * 10/2016 Hulka ..... E04B 1/40
9,617,785 B2 * 4/2017 Chou ..... E06B 9/24
2003/0163962 A1 * 9/2003 Jefferson ..... H02G 3/30 52/220.1
2005/0205216 A1 * 9/2005 Vrielink ..... E06B 9/323 160/23.1
2006/0118247 A1 * 6/2006 Olsen ..... A47H 2/00 160/38
2007/0119107 A1 * 5/2007 Shaw ..... E04D 13/15 52/287.1
2008/0127585 A1 * 6/2008 Ruhlmann ..... E04B 9/02 52/302.3
2012/0012260 A1 * 1/2012 Elinson ..... E06B 9/42 160/240
2012/0042549 A1 * 2/2012 Schattinger ..... G09F 13/18 40/541
2012/0325411 A1 * 12/2012 Petri ..... A47H 2/02 160/21
2013/0105649 A1 * 5/2013 Wills ..... E06B 9/42 248/224.8
2014/0226327 A1 * 8/2014 Yaphe ..... F21V 5/04 362/235
2014/0259830 A1 * 9/2014 Khieu ..... G09F 15/02 40/594
2016/0195250 A1 * 7/2016 Park ..... F21S 8/038 362/219
2017/0114593 A1 * 4/2017 Hebeisen ..... E06B 9/42
2017/0208980 A1 * 7/2017 Mullet ..... A47H 2/00
2018/0202157 A1 * 7/2018 Neal ..... F21V 21/025

FOREIGN PATENT DOCUMENTS

EP 0 409 029 A1 1/1991
EP 2843179 B1 12/2016
IT RA20 110 003 A 7/2012

* cited by examiner

BUILDING PERIMETER SYSTEMS

BACKGROUND OF THE INVENTION

The invention relates to improvements in building perimeter systems for ceiling and wall intersections that provide a pocket above the ceiling plane.

PRIOR ART

Various systems have been proposed for constructing a so-called "pocket" situated above the perimeter of a ceiling adjacent a wall, typically an exterior wall. These pockets have been entirely fabricated on-site, out of framing materials and drywall, or have been constructed of prefabricated units or assembled panels of sheet metal or extruded aluminum. Premanufactured aluminum extrusions of the prior art have, for example, three integral sides.

A perimeter pocket can house one or two roll-up shades, curtain rods or channels, retracted blinds, lighting strips and/or HVAC grills, for example.

The requisite dimensions of a perimeter pocket vary depending on building design and interior designers specifications. A common design variable in current construction is the "depth" of a pocket, i.e. the vertical rise of the pocket above the plane of the ceiling proper. Accordingly, there is a need for a perimeter pocket system that can readily and conveniently provide different pocket depths depending on the specific application of the building at which the system is installed.

SUMMARY OF THE INVENTION

The invention provides a building perimeter system with a main or base channel shaped pocket that couples with a selected one of different trim extensions. The selected extension corresponds to a desired rise of the pocket above the ceiling plane. The extension and main pocket channel have mating parts that facilitate their quick assembly into a horizontally locked joint that advantageously resists pendulum motion of the extension on the main channel.

The extension can be provided with an integral flange at a lower edge to support an acoustical ceiling tile or a sheet of drywall. In a preferred embodiment, the extension includes a flange on its concealed or outer side for attaching a stabilizing brace without piercing or otherwise affecting the aesthetics of the exposed side of the extension.

DESCRIPTION OF THE PREFERRED EMBODIMENT

Figure 1:
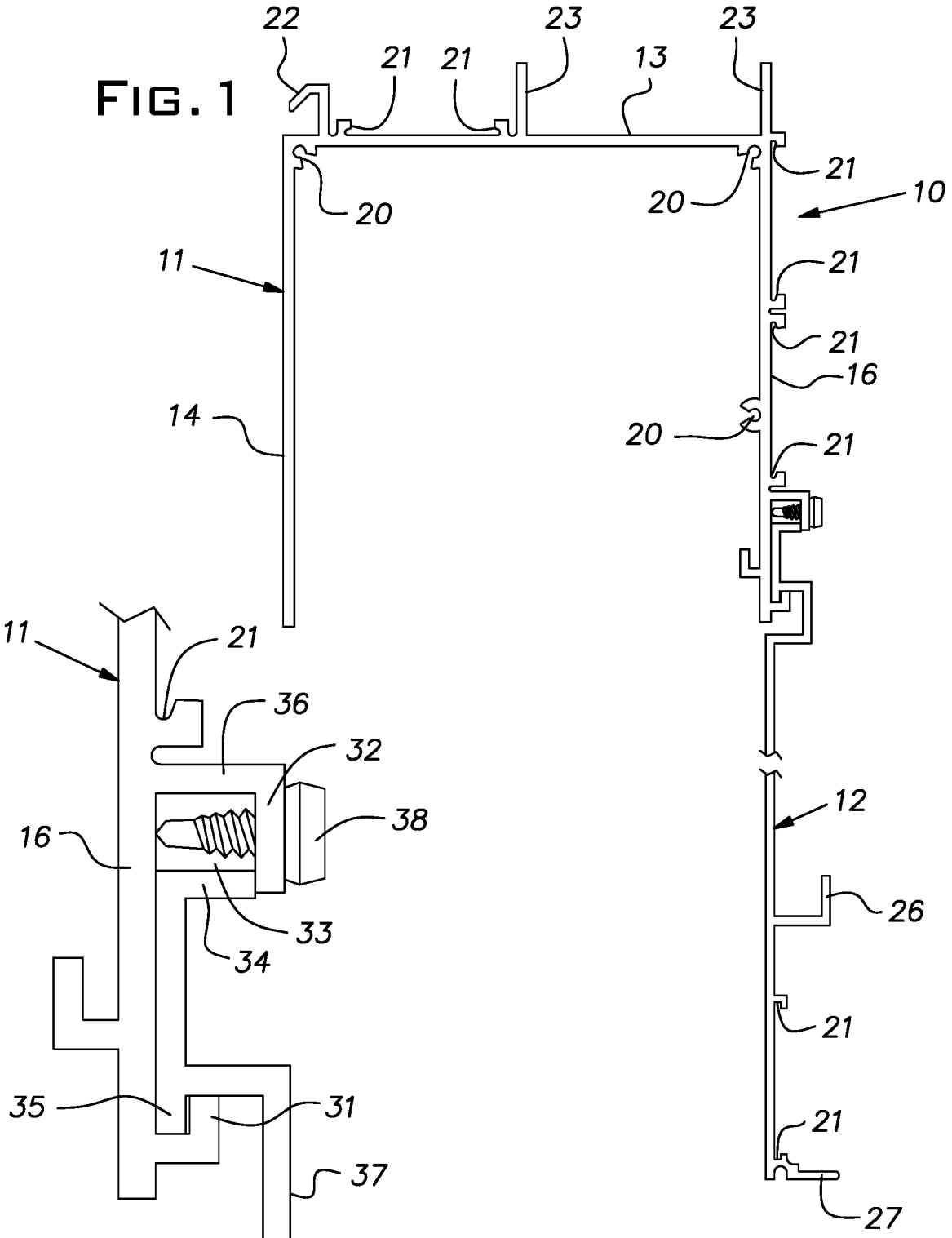
FIG. 1 is an end view of a perimeter pocket assembly of the invention.

FIG. 1 illustrates an end or cross-sectional view of an example of the inventive pocket assembly 10. In the illustrated example, the assembly comprises a main part 11 in the form of an inverted rectangular U-shaped channel and an accessory part 12 in the form of a depending generally planar extension. The channel 11 and extension 12 can be provided in suitable lengths, such as 10 foot, and can preferably each be formed as an integral one-piece extrusion of architectural grade aluminum.

By way of example, but not limitation, the main part of channel 11 can be nominally 5 inches wide measured across a top 13 and 5 inches deep measured along vertical legs or sides 14, 16.

The illustrated channel 11 and extension 12 are preferably extruded of architectural grade aluminum. It will be understood that planar formations on the top and sidewalls 13, 14 and 16 of the channel and the extension 12 have walls of generally uniform thickness. These formations and other protuberances on the walls and extension typically extend continuously for the full length of the subject part. The length of each part 11, 12 will be understood to project perpendicularly to the plane of the FIGS. 1 and 2 drawings.

Extruded slots 20 on inside surfaces of the channel 11 can receive screws to secure end plates to ends of the channel. Sets of spaced, opposed slots 21 on exterior surfaces of the top 13 and inner leg or side 16 of the channel 11 and the extension 12 can receive framing clips such as disclosed in U.S. Pat. No. 9,476,194 or splice clips such as disclosed in U.S. Pat. No. 9,464,433.

A hook 22 can be used to suspend the assembly 10 on an exterior wall of a building. Two upstanding flanges 23 on the top 13 of the channel 11 can be used to receive and be attached to conventional sheet metal studs therebetween and thereby facilitate mounting of the assembly 10 in a building.

Ideally, the extension 12 is substantially planar and has a flange 26 of el-shaped cross-section on its one side. A brace (not shown) can be attached to either outside face of the flange 26, for example, with a self-drilling screw to supplement the stability of the extension 12. In the illustrated embodiment, a lower edge of the extension 12 includes a flange 27 for supporting an acoustical ceiling tile.

The channel 11 and extension 12 have mutually engageable formations or coupling elements that enable the extension to be easily and quickly manually assembled on and supported by the channel. These elements on the channel include an upstanding right angle hook 31 and a downwardly oriented right angle flange 32 forming with the main part of the leg or side 16 an open bottom slot 33 with a width preferably substantially greater, i.e. more than three times, the wall thickness of the extension 12. The coupling elements at an upper margin of the extension 12 include a horizontal flange 34 and a depending hook 35 spaced vertically below the flange. The vertical distance across a tip of the depending hook 35 and the upper surface of the flange 34 is less than the distance between the upstanding hook 31 and a horizontal part 36 of the flange 32. An offset 37 in the body of the extension 12 clears the upstanding channel hook 31 when the extension is mounted on the channel.

In normal installations, the channel 11 is mounted on a supporting wall or is otherwise fixed in space. Thereafter, the extension 12 is manually mounted on the inner leg or side 16 by tilting the extension 12 out of plumb so that the flange 34 can be positioned in the wide slot 33 while the upstanding hook 31 is avoided by the orientation of the extension 12. With the extension 12 sufficiently elevated relative to the channel 11 so that the depending hook 35 of the extension is higher than the upstanding hook 31 of the channel leg 16, the extension 12 is swung back into plumb and then lowered. The hooks 35 and 31 mutually interengage and maintain the flange 34 in the slot 33 and inter-engaged with the vertical part of the right angle flange 32 and the adjacent part of the leg 16.

Figure 2:
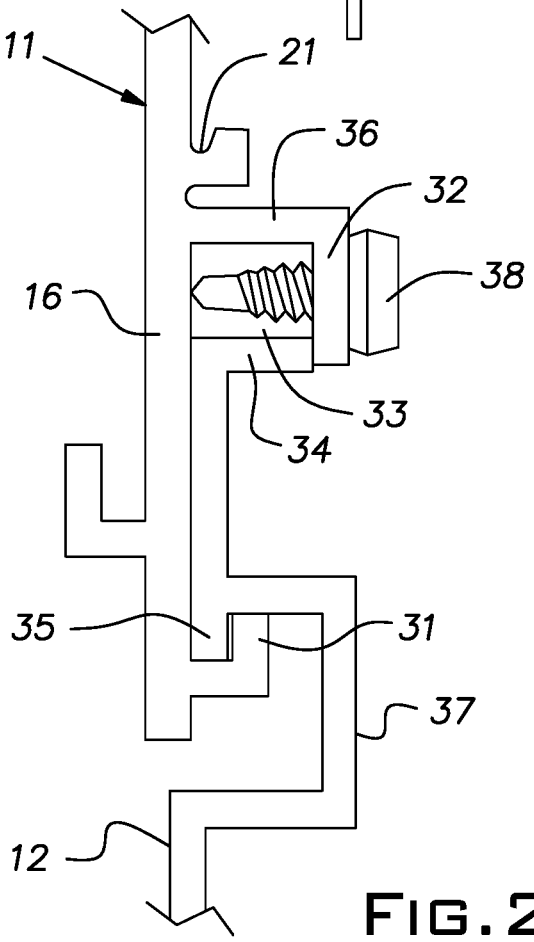
FIG. 2 is an enlarged view of a coupling area of the perimeter pocket assembly.

Inter-engagement of the hooks 31, 34 with each other and the extension flange 34 with the surfaces forming the slot 33, as depicted in FIGS. 1 and 2, allows the channel 11 to vertically support the extension 12 and resist pendulum or swinging movement of the lower portion of the extension about the joint or coupling formed between these elements. The vertical spacing of the channel and extension coupling elements, being substantially greater than their wall thickness or at least 1/15 the height of the extension as shown is beneficial in obtaining a rigid assembly.

The extension 12 and channel 11 can be releasably locked together with one or several longitudinally spaced self-drilling screws 38, (one is shown in the figures), driven through the vertical part of the channel flange 32 above the upper flange 34 on the extension 12. Removal of the screw(s) 38 allows the extension 12 to be separated from the channel 11 by reversing the assembly steps. When assembled, the vertical planes of the channel leg 16 and the extension 12 are substantially coincident.

While the channel 11 is illustrated with a rectangular U-shaped configuration, other shapes are contemplated. For example, the channel 11 can have a right angle configuration comprising only an upper side or top and a depending leg corresponding to the leg 16.

The extension 12 can be produced in various heights, for example, in 4, 6 and 8 inches. This enables an architect or interior designer to select an extension that, combined with the channel, forms a desired pocket height.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An architectural perimeter pocket assembly having at least a top and an inner side that form an open bottom pocket, the inner side including an upper section and a lower extension section separately formed from the upper section and extending along the upper section, each of the upper section and the lower extension section contributing to a vertical height of the inner side, the upper section comprising a coupling formation and the lower extension section comprising a coupling formation, the coupling formation of the upper section being adjacent a lower edge of the upper section and the coupling formation of the lower section being adjacent an upper edge of the lower section, the coupling formations being horizontally displaced from main portions of said sections that enable the upper section to support the lower extension section vertically and restrain the lower extension section from pendulum movement, wherein the upper section and lower extension section coupling formations include mutual engagement surfaces of both sections that include two engagement zones, surfaces of the upper section and lower extension section being in mutual contact at each of the two engagement zones, the two engagement zones being spaced apart by a distance at least equal to 1/15 of a vertical length of the lower extension section wherein said mutual engagement surfaces are engaged by lowering the lower extension section from an elevated position relative to the upper section to an installed position, wherein the upper section coupling formation includes a vertically upstanding hook and the lower extension section coupling formation includes a vertically depending hook adapted to inter-engage with the upstanding hook, wherein the upper section coupling formation further includes an open bottom slot formed by a leg of the upper section and a right angle flange, the open bottom slot having a width that is greater than a wall thickness of the upper section, wherein a vertical extent of the open bottom slot is greater than a height of the hooks, wherein the right angle flange comprises a horizontal part and a vertical part, the horizontal part projecting outwardly from the leg of the upper section, the vertical part extending from the horizontal part, wherein the lower extension section is locked in position relative to the upper section by a screw penetrating the vertical part of the right angle flange of the upper section.

2. The architectural perimeter pocket assembly as set forth in claim 1, wherein the lower extension section includes a flange projecting outwardly from a vertical plane along which the lower extension section lies, the flange being adapted to be secured to a stabilizing brace.

* * * * *